US006471337B1

(12) United States Patent
Inoue

(10) Patent No.: US 6,471,337 B1
(45) Date of Patent: Oct. 29, 2002

(54) INK-JET PRINTING APPARATUS, EJECTION RECOVERY METHOD FOR INK-JET PRINTING APPARATUS, AND FABRICATION METHOD OF INK-JET PRINTING HEAD

(75) Inventor: Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,002

(22) Filed: Oct. 25, 1999

(30) Foreign Application Priority Data

Oct. 27, 1998 (JP) ..... 10-304953

(51) Int. Cl.[7] ..... B41J 2/05
(52) U.S. Cl. ..... 347/57
(58) Field of Search ..... 347/57, 12–15, 347/20, 56, 45, 47–48, 65, 10, 17–18, 62, 63, 9, 68; 358/298, 296

(56) References Cited

U.S. PATENT DOCUMENTS

| | | | | | |
|---|---|---|---|---|---|
| 4,296,421 | A | | 10/1981 | Hara et al. | 347/48 |
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,499,479 | A | * | 2/1985 | Lee et al. | 347/15 |
| 4,558,333 | A | | 12/1985 | Sugitani et al. | 347/65 |
| 4,606,654 | A | * | 8/1986 | Sakurada et al. | 358/298 |
| 4,712,172 | A | | 12/1987 | Kiyohara et al. | 347/60 |
| 4,719,472 | A | | 1/1988 | Arakawa | 347/67 |
| 4,723,129 | A | | 2/1988 | Endo et al. | 347/56 |
| 4,740,796 | A | | 4/1988 | Endo et al. | 347/56 |
| 5,754,201 | A | * | 5/1998 | Ishinaga et al. | 347/62 |
| 5,880,762 | A | * | 3/1999 | Ishinaga et al. | 347/62 |

FOREIGN PATENT DOCUMENTS

| | | | |
|---|---|---|---|
| EP | 0 719 647 | 7/1996 | |
| JP | 54-56847 | 5/1979 | B41M/5/26 |
| JP | 55-132259 | 10/1980 | |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 62-48585 | 10/1987 | B41J/3/04 |
| JP | 2-78554 | 3/1990 | B41J/2/05 |

* cited by examiner

*Primary Examiner*—Anh T. N. Vo
*Assistant Examiner*—K. Feggins
(74) *Attorney, Agent, or Firm*—Fitzpatrick, Cella, Harper & Scinto

(57) ABSTRACT

By effectively executing ejection recovery and aging process of an ink-jet printing head having a plurality of electrothermal transducers in an ink passage, ejecting characteristics including the ejecting speed and ejecting quantity of ink are more stably kept under the printing operation for ejecting the ink by driving the electrothermal transducers. For that purpose, shift values of application timings of driving pulses to be applied to heaters in the ink passage of the ink-jet printing head are changed under the ejection recovery after the ink-jet printing head is set to a printing apparatus and/or the aging process when the ink-jet printing head is fabricated.

16 Claims, 8 Drawing Sheets

| ΔT(μs) | NUMBER OF DRIVING PULSES FOR PRELIMINARY EJECTION | CAVITATION POSITION |
|---|---|---|
| +5μs | 20 | ⓐ |
| +2μs | 20 | ⓑ |
| 0μs | 20 | ⓒ |
| -2μs | 20 | ⓓ |
| -5μs | 20 | ⓔ |

| ΔT(μs) | CAVITATION POSITION |
|---|---|
| +5μs | a |
| 0μs | b |
| -5μs | c |

INK-JET PRINTING APPARATUS, EJECTION RECOVERY METHOD FOR INK-JET PRINTING APPARATUS, AND FABRICATION METHOD OF INK-JET PRINTING HEAD

This application is based on Japanese Patent Application No. 10-304953 (1998) filed Oct. 27, 1998, the content of which is incorporated hereinto by reference.

BACKGROUND OF THE INVENTION

1. Field of the Invention

The present invention relates to an ink-jet printing apparatus, an ejection recovery method for the ink-jet printing apparatus, and a fabrication method of an ink-jet printing head.

The present invention intends for an ink-jet printing head, ink-jet printing head cartridge, and ink-jet printing apparatus to be used for a printer or video printer serving as an output terminal of a copying machine, a facsimile, a word processor, or a host computer. Particularly, the present invention intends for an ink-jet printing head having a substrate on which an electrothermal device for generating thermal energy used as the energy for ejecting ink is formed and a printing apparatus using the printing head. In this case, the concept of printing includes supply of ink (printing) to all ink supports to which ink is supplied such as cloth, yarn, paper, and sheet and moreover, includes not only a meaningful picture such as a character but also a pattern picture. A printing apparatus includes every type of information processor or a printer serving as an output unit of the information processor and the present invention can be applied to these purposes.

2. Description of the Related Art

A liquid-jet printing method performs printing by forming flying droplets of a printing liquid such as ink and attaching the droplets to a printing media to be printed such as paper or the like. A liquid-jet printing apparatus using the above printing method realizes low-noise high-speed printing and high-density printing. Moreover, the printing apparatus can be downsized because developing or fixing process is unnecessary for plain paper. Furthermore, this type of liquid-jet printing apparatus is particularly noticed because the productivity of the printing apparatus is high under mass production and the printing apparatus manufacturing cost is low.

To form the above flying droplets, a liquid-jet printing head using thermal energy is provided with an electrothermal transducer as means for heating a printing liquid. That is, the printing head has an exothermic resistor (hereafter referred to as "heater") capable of heating the printing liquid by producing heat when an electric signal is applied and a pair of electrodes for applying an electric signal to the exothermic resistor. The printing liquid is bubbled due to the heat generated by the heater and is ejected from an ink ejection port by the bubbling energy. Moreover, the printing liquid used in the above case is generally configured by a printing component such as a pigment or dye and water for dissolving or dispersing the printing component or a solvent component comprising water and a water-soluble organic solvent.

In case of the above water-based printing liquid, a heating limit for sudden evaporation ranges between 250 and 350° C. The heating limit temperature is equal to a temperature at which vapor is produced due to the calorie conducted to the printing liquid through a very thin and stable vapor film between the surface of the heater and the printing liquid.

Therefore, to form flying droplets and record them to a printing media to be printed by using the printing liquid having the above temperature characteristic, and supplying an electric signal to the heater and bubbling the printing liquid and thereby evaporating the printing liquid, the heater is repeatedly heated at a temperature in the range from ambient temperature up to 300 to 800° C. each time when an electric signal is supplied.

A heater and an electrode or the like are formed in accordance with a semiconductor process. For example, a wiring portion made of a metal serving as an electrical good conductor (e.g. electrode made of Al, Au, Ag, or Cu) is formed on an exothermic resistor (e.g. heat-resistant resistor made of $HfB_2$, $ZrB_2$, $TaN_2$, or TaSi) set on a substrate (e.g. made of Si, glass, or ceramic) through an intermediate layer (e.g. made of Ti or Cr). The wiring portion is formed by laminating the intermediate layer so as to be exposed in part and the exposed portion servers as a heater. Moreover, a protective film superior in heat resistance and printing-liquid cutoff characteristic for preventing electrolytic corrosion or oxidation due to the printing liquid is formed on the heater and electrode at need.

The above printing head ejects a printing liquid by applying an electric signal corresponding to a printing signal to a heater and repeatedly making the heater produce heat at a high temperature to heat the printing liquid. For a printing head having the above configuration and a printing apparatus provided with the printing head, treatments for improving the printing characteristics under printing (particularly, characteristics of a printing liquid such as viscosity, surface tension, and density or the like) are proposed.

The above treatments have been performed so far by a printing mode including the preliminary ejecting shown in U.S. Pat. No. 4,712,172 or a printing mode including the preliminary heating shown in U.S. Pat. Nos. 4,463,359, 4,296,421, 4,719,472, and 4,712,172 while a liquid-jet printing head is set to a printing apparatus. Each of these treatments ejects ink not contributing to printing of pictures from a printing head to recover an ink ejecting condition. Hereafter, the above ejection recovery is also referred to as "preliminary ejecting."

By performing the above treatments, the ejecting characteristic of a printing liquid under the printing operation is improved. However, these treatments are not sufficient to obtain the best printing state at the initial stage of using a printing head. Because a heater is repeatedly made to produce heat at a high temperature in the printing mode including the above preliminary ejecting and preliminary heating, phase change, stress change, oxidation, and composition change of the heater material are caused and moreover, resistance-value change occurs in the heater material. Furthermore, resistance distribution change of the heater material occurs due to the interface resistance between the heater material and a wiring portion (electrode) and the diffusion between both. Therefore, to improve the problems, a fabrication method of a liquid-jet printing head is disclosed in Japanese Patent Application Laying-Open No. 2-78554 (1990). This is a method of heating a heater material by applying to the heater an electric signal enough to stabilize the resistance value of the heater material in the aging process and thereby ink is ejected.

Thus, a preferable and stable ink ejecting condition can always be obtained even in long-time printing by the preliminary ejecting process for ejecting ink not contributing to printing of pictures from the ink-jet printing head mounted on an ink-jet printing apparatus, and by heating a heater material in the aging process when the ink-jet printing head is fabricated.

Because the frequency for handling image pictures has been recently increased, a request for high-picture-quality color printing, particularly for half-tone picture printing has been raised.

To express a halftone by an ink-jet printing apparatus, there is a method of expressing the halftone in accordance with the number of ink droplets applied to predetermined pixels on a printing medium (false halftone expression in accordance with binary numbers). Moreover, there is another method of expressing a halftone by using a plurality of printing heads with ejecting quantities different from each other or a plurality of printing heads capable of ejecting inks with densities different from each other and thereby, selecting and driving a printing head in accordance with the halftone. In case of these methods, however, it may be impossible to greatly raise the reliquid or a printing apparatus may be increased in size because a plurality of printing heads are used. Therefore, an ink-jet printing apparatus is requested which requires less space and realizes high-reliquid printing at a low cost by changing eject quantities of one printing head at various levels.

To attain the above object, Japanese Patent Application Publication No. 62-48585 (1987) discloses a gradation printing method of realizing high-picture-quality printing by changing sizes of ejected ink droplets. In case of this printing method, a plurality of heaters with areas different from each other are arranged in an ink passage to independently control each heater.

However, to realize the so-called multiple-heater ink-jet printing head in which a plurality of heaters are arranged in an ink passage, there are some problems.

First, there are requests for improving the ink ejecting reliability and the ink-droplet impact accuracy immediately after ink eject when the time of ejecting no ink is long by improving the ink ejecting speed in order to not only make the ink ejecting quantity changeable but also perform higher-quality printing. Particularly, when a multiple-heater ink-jet printing head is used, there are some cases in which it is difficult to increase the ink ejecting speed of relatively small droplets in volume in order to eject the droplets from a relatively large ink ejection port. In this case, ink ejection may be disturbed due to accidental imperfect bubbling or the state nearby the ink ejection port. A small-droplet-ejecting heater having a small heater area easily influences ink ejection even due to a small foreign matter on the heater surface. Therefore, there are some cases in which the existing preliminary ejecting process or heating in the aging process is insufficient to stably eject small droplets. Moreover, the preliminary ejecting process or heating in the aging process has an advantage of removing a foreign matter or the like from the surface of a heater. In the case of a multiple-heater ink-jet printing head, however, when above preliminary ejecting process or heating in the aging process is performed by simultaneously driving a plurality of heaters, the position where a bubble for ejecting ink disappear is frequently deviated from the center of a heater. Therefore, the cavitation effect for removing burnt deposits or foreign matters from the surface of a heater frequently lowers.

SUMMARY OF THE INVENTION

It is an object of the present invention to more stably maintain the ejecting characteristics including the ejecting speed and ejecting quantity of ink under the picture printing operation of driving a plurality of electrothermal transducers and thereby ejecting ink by effectively applying ejection recovery and aging to an ink-jet printing head provided with the electrothermal transducers for one ink passage.

In the first aspect of the present invention, there is provided an ink-jet printing apparatus for printing an image on a printing medium by using an ink-jet printing head capable of ejecting ink from an ink ejection port communicating with an ink passage, and capable of generating a bubble in ink of the ink passage by the heat produced by a plurality of electrothermal transducers set to the ink passage, wherein control means is included which changes shift values of the heat-producing timings of the electrothermal transducers by changing shift values of driving signals to be applied to the electrothermal transducers when ejecting the ink not contributing to printing of the image from the ink-jet printing head to recover an ink ejecting condition.

In the second aspect of the present invention, there is provided an ejection recovery method for an ink-jet printing apparatus for printing an image on a printing medium by using an ink-jet printing head capable of ejecting ink from an ink ejection port communicating with an ink passage, and capable of generating a bubble in ink of the ink passage by the heat produced by a plurality of electrothermal transducers set to the ink passage, comprising the step of:

changing shift values of driving signals to be applied to a plurality of electrothermal transducers and thereby changing shift values of heat-producing timings of the electrothermal transducers when performing ejection recovery for recovering an ink ejecting condition by ejecting the ink not contributing to printing of the image from the ink-jet printing head.

In the third aspect of the present invention, there is provided a fabrication method of an ink-jet printing head capable of ejecting ink from an ink ejection port communicating with an ink passage by generating a bubble in the ink of an ink passage by the heat produced by a plurality of electrothermal transducers set to the ink passage, comprising the step of:

changing shift values of driving signals to be applied to the electrothermal transducers and thereby changing shift values of heat-producing timings of the electrothermal transducers when ejecting ink from the ink-jet printing head for aging process.

In case of the present invention, an ink-jet printing head provided with a plurality of electrothermal transducers for one ink passage shifts the application timing of a driving signal to be applied to each of the electrothermal transducers in the ejection recovery of an ink-jet printing head while the head is set to an ink-jet printing apparatus or the aging of the head while being fabricated. Thereby, it is possible to decrease long-term deterioration of the printing quality and to improve the printing quality at the initial stage after fabrication.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of the present invention will be described below by referring to the accompanying drawings. The present invention is not restricted to the following embodiments. Moreover, for the embodiments, ink is described as a liquid to be ejected. However, a liquid is not restricted to ink. Any liquid can be used as long as the liquid can be ejected by using the present invention.

First Embodiment

Figure 1:
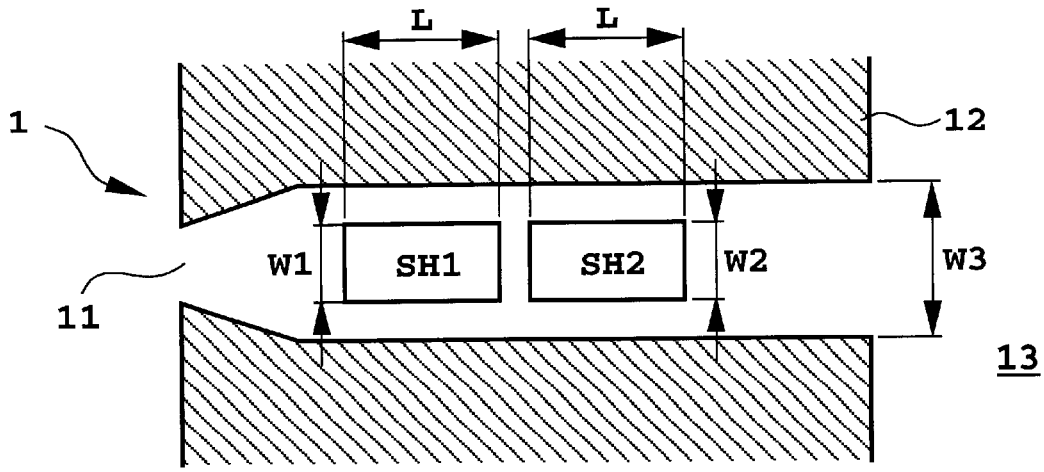
FIG. 1 is a sectional view of an ink passage of the printing head of a first embodiment of the present invention.

FIG. 1 is a schematic sectional view of an ink passage of the printing head 1 of the first embodiment of the present invention.

A plurality of ink passages 12 are arranged on the printing head 1 in parallel at a density of 360 dpi and each ejection port 11 communicates with a common liquid chamber 13. Moreover, each ink passage 12 is provided with two heaters (electrothermal transducers) SH1 and SH2. The length L of the heater SH1 and that of the heater SH2 are equal to 95 $\mu$m. The width W1 of the heater SH1 is 30 $\mu$m and the width W2 of the heater SH2 is 30 $\mu$m. The width W3 of each ink passage 12 is set to 58 $\mu$m and the height of it is set to 40 $\mu$m.

The ink supplied from an ink tank (not illustrated) is temporarily stored in the liquid chamber 13 and then enters each ink passage 12 in accordance with capillarity to form a meniscus at the ejection port 11. Thereby, the ink passages 12 are filled with ink. By applying a driving pulse to the heaters SH1 and SH2 under the above state to make the heaters produce heat and providing thermal energy for the ink, a state change followed by a sudden volume change (generating a bubble) occurs in the ink and the ink is ejected from the ejection port 11 by an action force according to the state change.

The ink-jet printing head 1 used for this embodiment makes it possible to obtain a higher-definition picture by changing ejecting quantities of ink when driving only the heater SH1 and when driving two heaters SH1 and SH2 at the same time.

Figure 2:
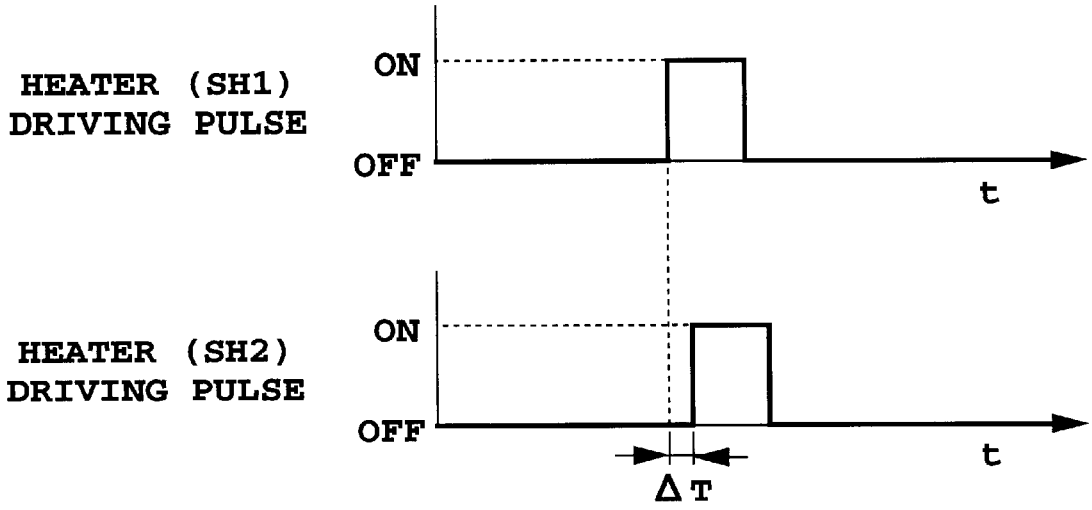
FIG. 2 is an illustration of application timing of a driving signal to a heater in FIG. 1.
Figures 3A, 3B:
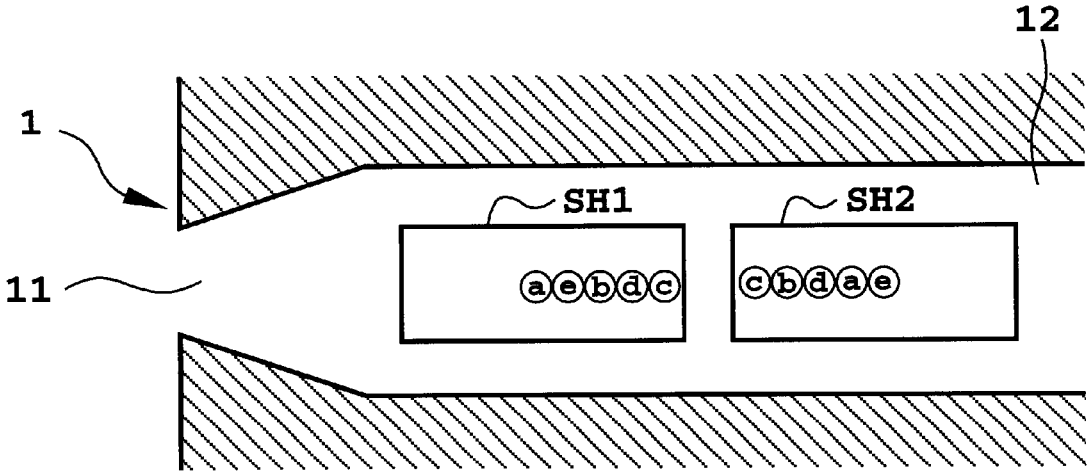
FIG. 3A is an illustration of application timing of a driving signal in case of the first embodiment of the present invention.
FIG. 3B is an illustration of cavitation positions changed depending on the application timing in FIG. 3A.

The present inventors studied the effect when shifting the application timing of an electric signal applied to the heater SH1 and SH2 on the above-described preliminary ejecting performed while printing. FIG. 2 is an illustration showing the preliminary ejection driving studied for this embodiment, in which $\Delta T$ denotes a shift value. FIG. 3A shows the relation between the shift value $\Delta T$, the number of driving pulses for preliminary ejecting, and the cavitation position when performing the preliminary ejecting for one time of preliminary ejecting. FIG. 3B is an illustration showing the cavitation positions ⓐ to ⓔ.

In case of this embodiment, ink droplets are ejected from the ejection port 11 100 times for one-time preliminary ejecting. In this case, the application timing of every 100 driving pulses to be applied to the heaters SH1 and SH2 is divided into five stages and the five stages are shifted from each other. That is, as for the first-stage 20 pulses to be applied to the heaters SH1 and SH2, driving pulses are applied to the heater SH2 and then, after 5 $\mu$sec passes, driving pulses are applied to the heater SH1. As for the next second-stage 20 pulses, the shift value is set to 2 $\mu$sec. The next third-stage 20 pulses are applied to the heaters SH1 and SH2 at the same time. As for the next fourth-stage 20 pulses, driving pulses are applied to the heater SH2 2 $\mu$sec after applying driving pulses to the heater SH1. As for the next fifth-stage 20 pulses, the shift value is set to 5 $\mu$sec. Thus, by changing shift values of driving timings of the heaters SH1 and SH2 into five stages, it is possible to shift cavitation positions that are generated at constant positions in the conventional driving.

Figure 4:
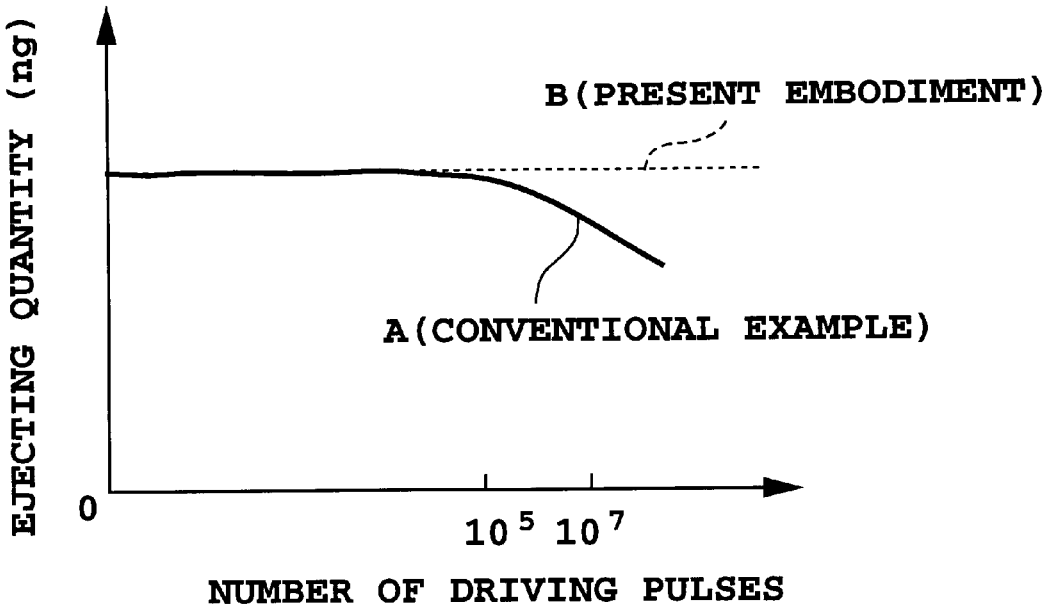
FIG. 4 is an illustration of the relation between the applied number of driving pulses and the ejecting quantity of ink in case of the first embodiment of the present invention.

FIG. 4 shows the relation between the change of ink ejecting quantities and the number of driving pulses to be applied to the ink-jet printing head 1.

Symbol A in FIG. 4 denotes the change characteristic of a conventional example and B denotes the change characteristic of this embodiment and both perform preliminary ejecting by interrupting the operation for printing at a preset preliminary-ejecting interval similarly to the case of conventional preliminary ejecting. The preliminary ejection driving in the former conventional case applies driving pulses (electric signals) to the heaters SH1 and SH2 at the same time. The latter case of this embodiment performs preliminary ejecting in accordance with the above preliminary ejection driving for causing shift rates of driving timing of heaters SH1 and SH2 to be changed as described previously.

As shown in FIG. 4, in the case of the conventional example, the ink ejecting quantity starts decreasing after the number of driving pulses to be applied exceeds $10^5$ and the ink ejecting quantity is decreased by 20% or more when the number of driving pulses to be applied reaches $10^7$. This is because sandy burnt deposits or cracked burnt deposits are produced on the surface of a heater. On the other hand, in the case of the ink-jet printing head performed by the preliminary ejection driving of this embodiment, the ink ejecting quantity is not decreased. This is probably because cavitation has effectively occurred and foreign matters are removed from the surface of the heater.

Figure 5:
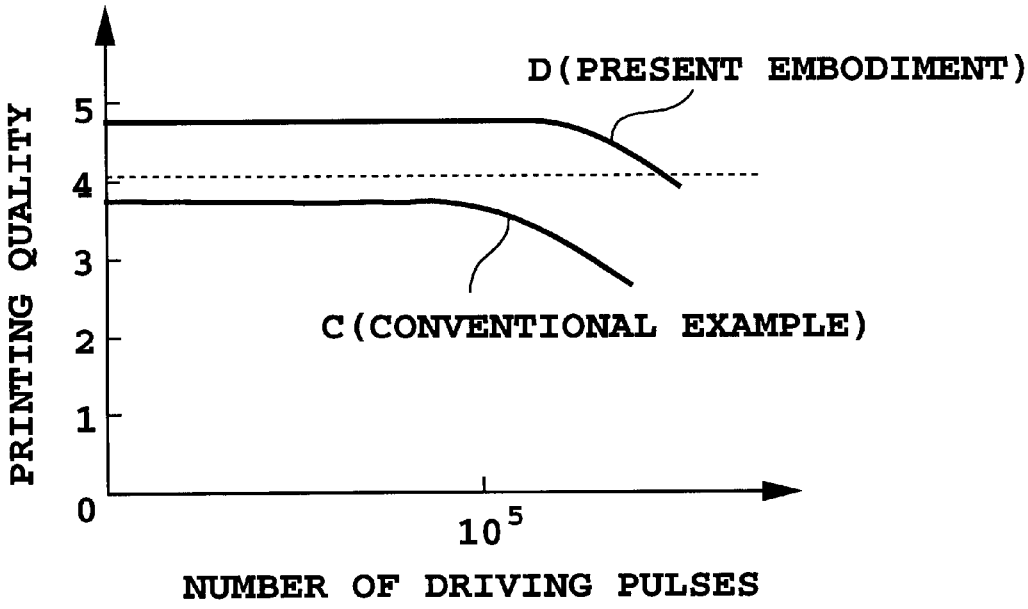
FIG. 5 is an illustration of the initial stage of printing quality through aging by the first embodiment of the present invention.

Moreover, the heater material is heated in the aging process under fabrication in accordance with the heater driving for causing shift values of driving timing of the heaters to be changed in the case of this embodiment. Then, an image is printed by dots formed due to ink droplet impact by using the ink-jet printing head immediately after fabricated in accordance with the above treatment. Then, a least square line serving as a criterion is obtained from vertical and horizontal lines of the printed image respectively and the shift of a dot formed due to ink droplet impact from a least square line is measured through the observation using a microscope. FIG. 5 shows five-stage evaluation results of printing quality from "1 (bad)" to "5 (good)" in accordance with the above ink-droplet impact point error measuring method.

The printing quality at the initial stage after fabrication is improved by performing the aging (characteristic D in FIG. 5) of the heater driving with changed shift values of application timing of this embodiment compared to the case of the conventional aging (characteristic C in FIG. 5) in accordance with the simultaneous timing driving of a plurality of heaters. This is probably because a cavitation force generated due to disappearance of a bubble produced on the surface of a heater when ink is ejected occurs in a larger range on the surface of the heater in accordance with the heater driving whose timing is shifted in the case of this embodiment, the cavitation force removes foreign matters from the surface of the heater when an ink-jet printing lo head is fabricated, and thereby it is possible to further stably ejecting ink. Moreover, in the above aging process, it is also permitted to apply a driving pulse having a large thermal energy produced in a heater instead of a driving pulse (electric signal) applied under normal printing as a driving pulse (electric signal) to be applied to the heater. Thereby, it is possible to increase a bubble produced on the heater in size when ink is ejected, also increase the cavitation force generated due to disappearance of the bubble, and further increase the effect of the cavitation force.

Second Embodiment

Figure 6:
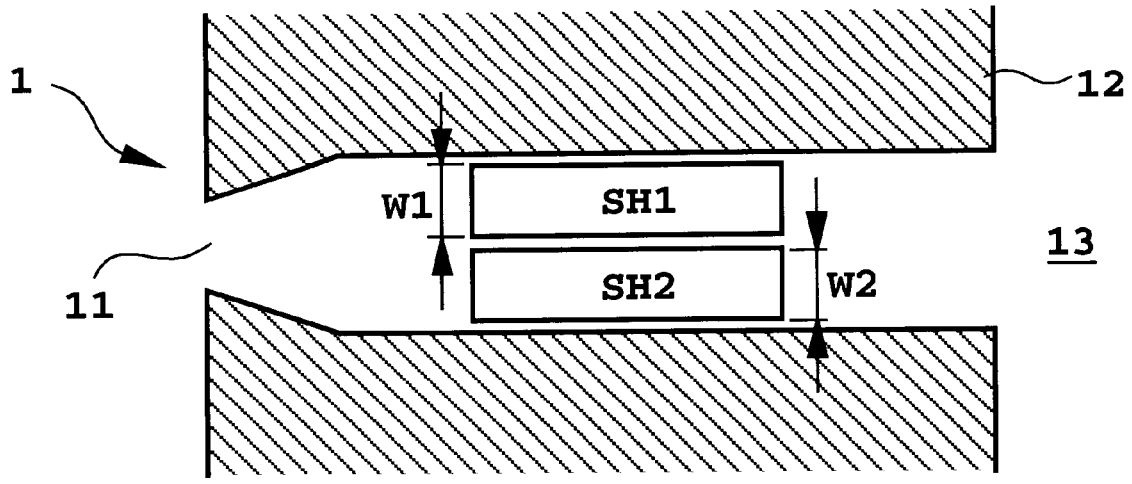
FIG. 6 is a sectional view of an ink passage of the printing head of a second embodiment of the present invention.

FIG. 6 is a schematic sectional view of an ink passage of the ink-jet printing head of a second embodiment of the present invention.

In case of this embodiment, widths W1 and W2 of the heaters SH1 and SH2 are 20 $\mu$m and areas of the heaters are equal to each other. Moreover, these two heaters SH1 and SH2 are located at equal distance from an ejection port 11. Other dimensions are the same as the case of the first embodiment.

Figure 8:
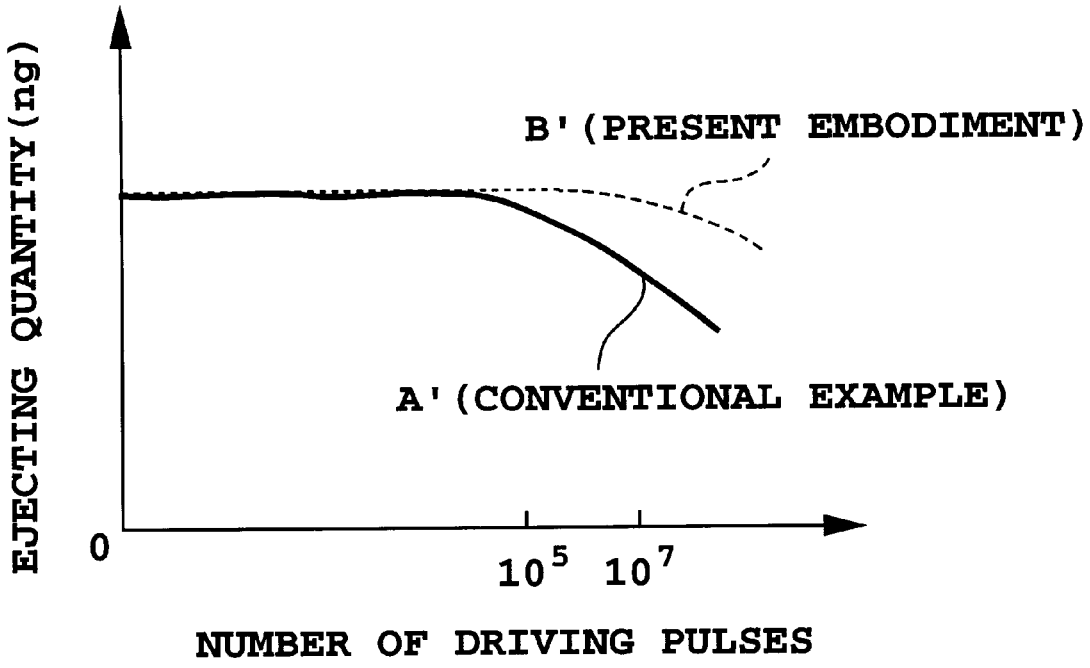
FIG. 8 is an illustration of the relation between the applied number of driving pulses and the ejecting quantity of ink in case of the second embodiment of the present invention.

Heater driving same as the case of the above first embodiment is also applied to this embodiment. FIG. 8 shows the relation between the change of ink ejecting quantities and the number of driving pulses to be applied to an ink-jet printing head similarly to the case of FIG. 4 of the above embodiment.

As apparent from FIG. 8, in case of the conventional example, the ejecting quantity of ink starts decreasing after the number of driving pulses to be applied exceeds $10^5$, and decreases by 30% or more when the number of driving pulses to be applied reaches $10^7$. In case of the ink-jet printing head of this embodiment to which preliminary ejection driving with changed shift values of driving timing of the heaters is applied, decrease of ink ejecting quantity is controlled to 10%.

Figures 7A, 7B:
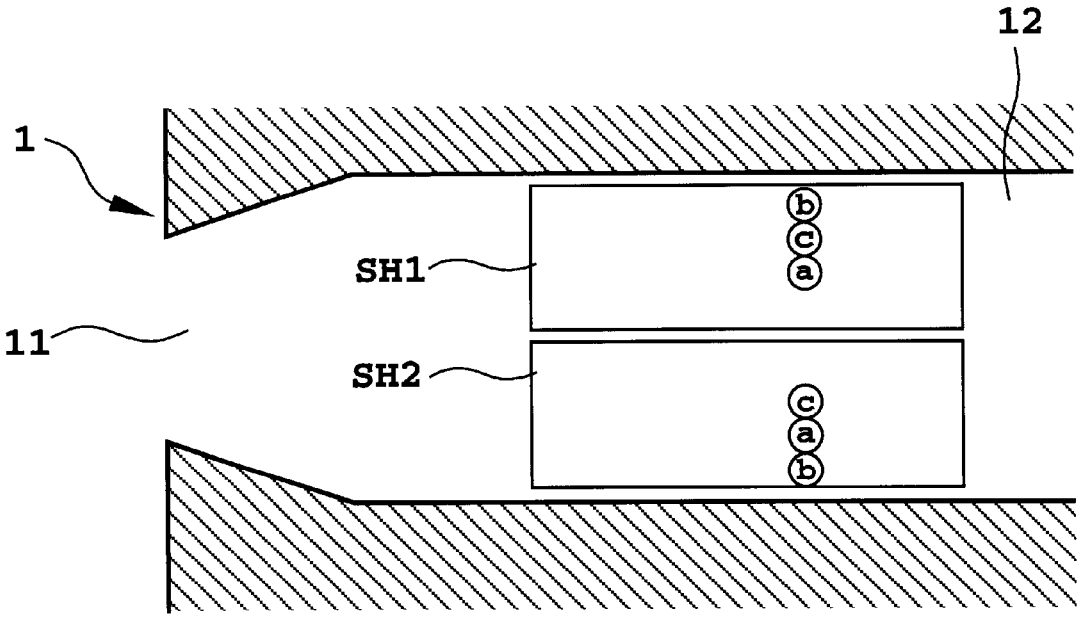
FIG. 7A is an illustration of the application timing of a driving signal of the second embodiment of the present invention.
FIG. 7B is an illustration of cavitation positions changed depending on the application timing in FIG. 7A.

FIG. 7A shows an illustration of the relation between shift value $\Delta T$ and cavitation position and FIG. 7B shows those cavitation positions. In case of this embodiment in which the heaters SH1 and SH2 are arranged in parallel with the ejection port 11, it is difficult to increase widths of the heaters SH1 and SH2. Therefore, even if driving with shifted application timing of driving pulses is performed, it is difficult to greatly change cavitation positions and the effect is slightly small compared to the case of the first embodiment. However, also in case of this embodiment, burnt deposits can be completely removed by the change of cavitation positions.

Other Embodiments

Figure 9:
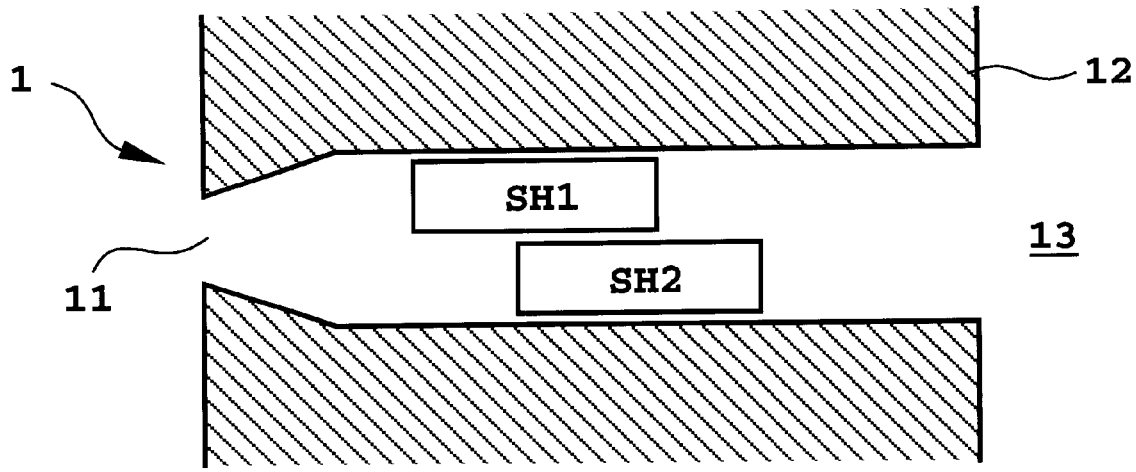
FIG. 9 is a sectional view of an ink passage of the printing head of another embodiment of the present invention.
Figure 10:
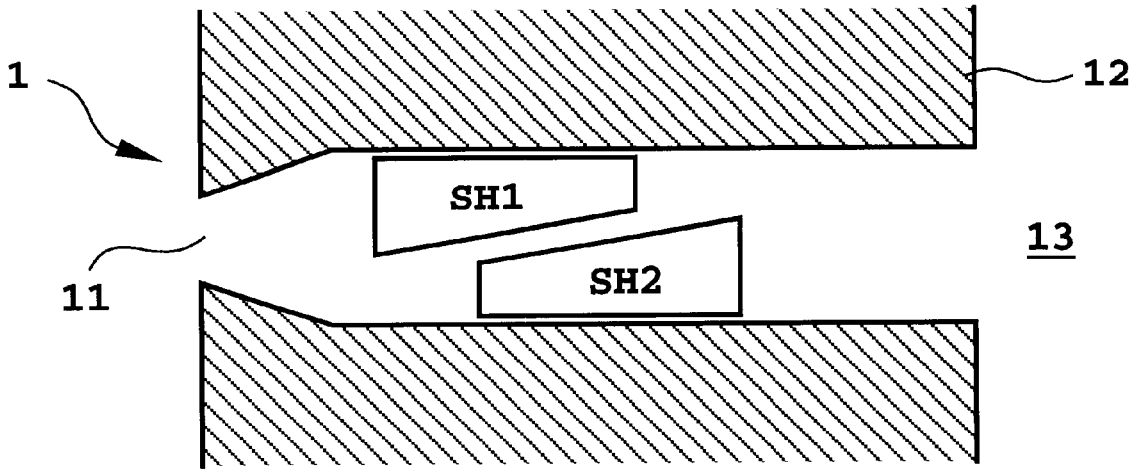
FIG. 10 is a sectional view of an ink passage of the printing head of still another embodiment of the present invention.

Moreover, it is confirmed that even arrangements of heaters SH1 and SH2 shown in FIGS. 9 and 10 have the same effect. Thus, the arrangement of heaters and the number of heaters arranged are not particularly restricted. Moreover, it is permitted to use a plurality of heaters with different sizes. Furthermore, it is permitted to make widths and sizes of heater driving pulses different from each other correspondingly to the heat produced by each heater. Furthermore, it is permitted to change at least the application start timings of driving pulses to a plurality of heaters in the ejection recovery process and aging process.

Configuration Example of Printing Apparatus

Figure 11:
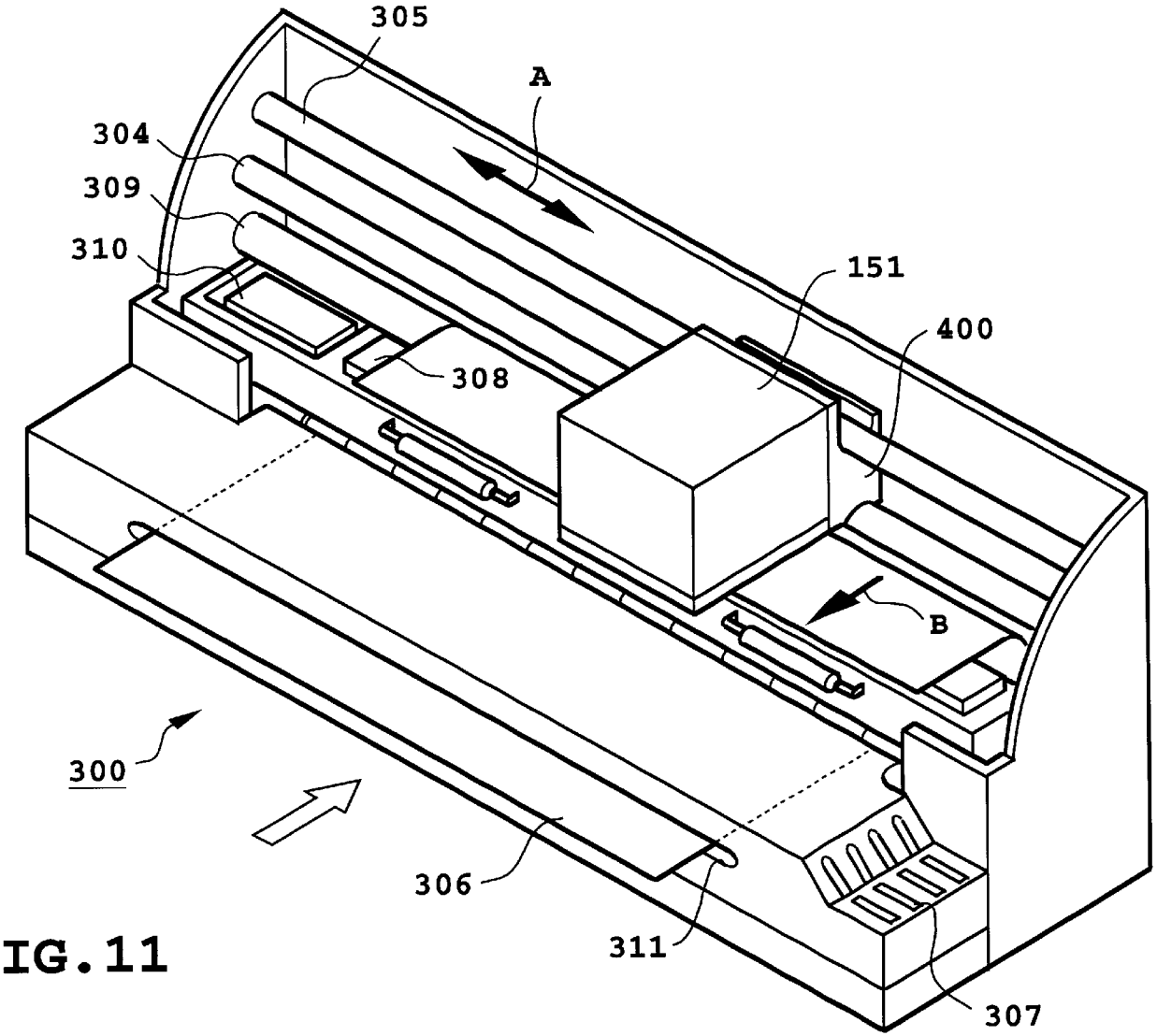
FIG. 11 is a schematic perspective view of an ink-jet printing apparatus of the present invention.

FIG. 11 shows a general configuration of an ink-jet printing apparatus according to the present invention.

In an ink-jet printing apparatus 300, a carriage 400 slidably engages with two guide shafts 304 and 305 extending in parallel with each other. The carriage 400 is reciprocated in the main scanning direction shown by an arrow A along the guide shafts 304 and 305 by a driving motor (not illustrated) and a driving-force transfer mechanism (not illustrated) such as a belt or the like for transferring the driving force. The above-described printing head and an ink tank 151 serving as an ink vessel for storing the ink used for the head are mounted on the carriage 400.

For example, 64 ink ejection ports 11 same as the above-described printing head 1 are formed on the face of the printing head facing a sheet 306 serving as a printing medium so as to be arranged along the carrying direction of a sheet 306. As described above, an ink passage 12 communicating with each ejection port 11 is formed on the printing head and the heaters (electrothermal transducers) SH1 and SH2 for producing the thermal energy for ejecting ink are provided correspondingly to each ink passage 12.

The sheet 306 is inserted through an insertion port 311 formed at the front end of the printing apparatus, the carrying direction of the sheet 306 is inverted, and the sheet 306 is carried under the moving area of the carriage 400 along the sub-scanning direction shown by the arrow B perpendicular to the main scanning direction A by a feed roller 309. The printing head mounted on the carriage 400 prints an image in a printing area on the sheet 306 supported by a platen 308 while the head moves.

As described above, the entire sheet 306 is printed while the printing operation for one line according to the movement of the carriage 400, that is, the printing operation at the width corresponding to the width of the ejection port arrangement on the printing head and the feed operation for the sheet 306 are alternately repeated. The printed sheet 306 is ejected to the front of the printing apparatus.

A recovery-system unit 310 capable of facing the bottom of each printing head on the carriage 400 is provided for the left end of an area in which the carriage 400 can move. The recovery-system unit 310 makes it possible to perform the operation for capping the ejection port of each printing head and the operation for drawing ink from the ejection port of each printing head while printing is not performed. Moreover, a predetermined position at the left end side of the movable area of the carriage 400 is set as the home position of each printing head. Furthermore, the recovery-system unit 310 is able to receive the ink preliminarily ejected from a printing head by a cap and then to treat the ink as waste ink.

Furthermore, an operation section 307 provided with a switch and a display element is set to the right end of the printing apparatus. The switch is used to turn on/off the power supply of the printing apparatus or set various printing modes and the display element displays various states of the printing apparatus.

Other

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high reliquid printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multicolor and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 300° C.–700° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for printing an image on a printing medium by using an ink-jet printing head capable of ejecting ink from an ink ejection port communicating with an ink passage, and capable of generating a bubble in ink of the ink passage by the heat produced by a plurality of electrothermal transducers set to the ink passage, wherein control means is included which changes shift values of the heat-producing timings of the electrothermal transducers by changing shift values of driving signals to be applied to the electrothermal transducers when ejecting the ink not contributing to printing of the image from the ink-jet printing head to recover an ink ejecting condition.

2. The ink-jet printing apparatus as claimed in claim 1, wherein the control means applies driving pulses having almost the same width to the electrothermal transducers as the driving signals by shifting the pulses from each other.

3. The ink-jet printing apparatus as claimed in claim 1, wherein the control means changes at least the application start timings of the driving signals to be applied to the electrothermal transducers.

4. The ink-jet printing apparatus as claimed in claim 1, wherein the electrothermal transducers are arranged by being shifted from each other in the longitudinal direction of the ink passage.

5. The ink-jet printing apparatus as claimed in claim 1, wherein the electrothermal transducers are arranged by being shifted from each other in the width direction of the ink passage.

6. The ink-jet printing apparatus as claimed in claim 1, wherein a cap for receiving the ink not contributing to printing of the image ejected from the ink-jet printing head is included.

7. The ink-jet printing apparatus as claimed in claim 1, comprising:

first moving means for relatively moving the ink-jet printing head and the printing medium in the main scanning direction; and second moving means for relatively moving the ink-jet printing head and the printing medium in the subscanning direction intersecting the main scanning direction.

8. An ejection recovery method for an ink-jet printing apparatus for printing an image on a printing medium by using an ink-jet printing head capable of ejecting ink from an ink ejection port communicating with an ink passage, and capable of generating a bubble in ink of the ink passage by the heat produced by a plurality of electrothermal transducers set to the ink passage, comprising the step of:

changing shift values of driving signals to be applied to a plurality of electrothermal transducers and thereby changing shift values of heat-producing timings of the electrothermal transducers when performing ejection recovery for recovering an ink ejecting condition by ejecting the ink not contributing to printing of the image from the ink-jet printing head.

9. The ejection recovery method for an ink-jet printing apparatus as claimed in claim 8, wherein driving pulses having almost the same width are applied to the electrothermal transducers as the driving signals by shifting the pulses from each other.

10. The ejection recovery method for an ink-jet printing apparatus as claimed in claim 8, wherein at least application start timings of the driving signals to be applied to the electrothermal transducers are changed.

11. A fabrication method of an ink-jet printing head capable of ejecting ink from an ink ejection port communicating with an ink passage by generating a bubble in the ink of an ink passage by the heat produced by a plurality of electrothermal transducers set to the ink passage, comprising the step of:

changing shift values of driving signals to be applied to the electrothermal transducers and thereby changing shift values of heat-producing timings of the electrothermal transducers when ejecting ink from the ink-jet printing head for aging process.

12. The fabrication method of an ink-jet printing head as claimed in claim 11, wherein driving pulses having almost the same width are applied to the electrothermal transducers as the driving signals by shifting the pulses from each other.

13. The fabrication method of an ink-jet printing head as claimed in claim 11, wherein at least application start timings of the driving signals to be applied to the electrothermal transducers are changed.

14. The fabrication method of an ink-jet printing head as claimed in claim 11, wherein the electrothermal transducers are arranged by being shifted from each other in the longitudinal direction of the ink passage.

15. The fabrication method of an ink-jet printing head as claimed in claim 11, wherein the electrothermal transducers are arranged by being shifted from each other in the width direction of the ink passage.

16. The fabrication method of an ink-jet printing head as claimed in claim 11, wherein thermal energy larger than that under the printing operation by the ink-jet printing head is generated by the electrothermal transducers in accordance with the driving signals to be applied to the electrothermal transducers at the time of aging process.

* * * * *

UNITED STATES PATENT AND TRADEMARK OFFICE

CERTIFICATE OF CORRECTION

PATENT NO. : 6,471,337 B1
DATED : October 29, 2002
INVENTOR(S) : Ryoji Inoue

It is certified that error appears in the above-identified patent and that said Letters Patent is hereby corrected as shown below:

Column 2,
Line 10, “an electrical good” should read -- a good electrical --; and
Line 17, “servers” should read -- serves --.

Column 3,
Line 56, “pear” should read -- pears --.

Column 4,
Line 45, “case” should read -- the case --.

Column 6,
Line 19, “passes,” should read -- pass, --.

Column 7,
Line 20, “lo” should be deleted;
Line 22, “ejecting” should read -- eject --;
Line 36, “case” should read -- the case --;
Line 39, “distance” should read -- distances --;
Line 40, “as” should read -- as in --; and
Line 42, “Heater driving same as” should read -- The same heater driving as in --.

Column 9,
Line 44, “to” should read -- into --; and
Line 62, “consists” should read -- consist --.

Column 10,
Line 37, “300ºC.-700ºC.” should read -- 30ºC - 70ºC --.

UNITED STATES PATENT AND TRADEMARK OFFICE

CERTIFICATE OF CORRECTION

PATENT NO. : 6,471,337 B1
DATED : October 29, 2002
INVENTOR(S) : Ryoji Inoue

It is certified that error appears in the above-identified patent and that said Letters Patent is hereby corrected as shown below:

Column 11,
Line 44, "subscan-" should read -- sub-scan- --.

Signed and Sealed this

Twenty-ninth Day of April, 2003

JAMES E. ROGAN
*Director of the United States Patent and Trademark Office*